US005927882A

United States Patent [19]

Kageyama

[11] Patent Number: 5,927,882

[45] Date of Patent: Jul. 27, 1999

[54] DISPENSER FOR SELECTIVELY EXTENDING AND RETRACTING A SUBSTANTIALLY STICK-SHAPED OBJECT AND WRITING INSTRUMENT

[75] Inventor: Shuhei Kageyama, Kawagoe, Japan

[73] Assignee: Kotobuki Co., Ltd., Saitama, Japan

[21] Appl. No.: 08/749,356

[22] Filed: Nov. 20, 1996

[30] Foreign Application Priority Data

Nov. 20, 1995 [JP] Japan ..... 7-301584

[51] Int. Cl.[6] ..... B43K 29/02

[52] U.S. Cl. ..... 401/52; 401/65; 401/99

[58] Field of Search ..... 401/52, 65, 99

[56] References Cited

U.S. PATENT DOCUMENTS

| | | | |
|---|---|---|---|
| 1,518,822 | 12/1924 | Saadi | 401/99 X |
| 3,883,253 | 5/1975 | Naruse et al. | 401/65 |
| 5,022,774 | 6/1991 | Kageyama et al. . | |
| 5,062,727 | 11/1991 | Kageyama et al. . | |
| 5,090,831 | 2/1992 | Kageyama et al. | 401/52 |
| 5,207,522 | 5/1993 | Kageyama et al. . | |
| 5,234,275 | 8/1993 | Gueret . | |
| 5,236,270 | 8/1993 | Kageyama et al. . | |
| 5,370,471 | 12/1994 | Kageyama et al. . | |
| 5,662,425 | 9/1997 | Mitsuya | 401/52 |

FOREIGN PATENT DOCUMENTS

| | | | |
|---|---|---|---|
| 292098 | 12/1990 | Japan | 401/52 |
| 138199 | 6/1991 | Japan | 401/99 |
| 425499 | 1/1992 | Japan | 401/52 |

*Primary Examiner*—Steven A. Bratlie
*Attorney, Agent, or Firm*—Whitham, Curtis & Whitham

[57] ABSTRACT

A dispenser for selectively extending and retracting a substantially stick-shaped object, comprising an outer tubular casing having an opened end, a closed end, a first chamber adjacent the opened end, and a second chamber adjacent the closed end for storing at least one spare stick-shaped object therein, the first and second chambers communicating with each other, a dispenser structure removably received in the first chamber, and a retaining mechanism for retaining the dispenser structure in the first chamber. A writing instrument of side-knock-type or side-slide-type provided with a dispenser for selectively extending and retracting a substantially stick-shaped object is also disclosed.

14 Claims, 6 Drawing Sheets

DISPENSER FOR SELECTIVELY EXTENDING AND RETRACTING A SUBSTANTIALLY STICK-SHAPED OBJECT AND WRITING INSTRUMENT

BACKGROUND OF THE INVENTION

1. Field of the Invention

This invention relates to a dispenser for selectively extending and retracting a substantially stick-shaped object, such as a rubber eraser, lead crayon, a pastel, glue, chalk, rouge or eyebrow pencil lead, and a writing instrument, e.g., a mechanical pencil, a ball-point pen, a sign pen or a marking pen, equipped with such a dispenser.

2. Description of the Prior Art

U.S. Pat. No. 5,234,275, Gueret, issued Aug. 10, 1993. discloses a holder for delivery or retraction of a product stick in the direction of rotation of a tubular element with respect to a casing through an outlet end of the tubular element. The conventional holder has a room for housing the product stick but has no room for storing a spare product stick. If the holder has such a room for storing a spare product stick, it may be helpful to easily and always replace the product stick, which becomes shortened by consumption, with spare product stick stored in the additional room.

U.S. Pat. No. 5,022,774, S. Kageyaua et al., issued Jun. 11, 1991 and assigned to the assignee of the present application, U.S. Pat. No. 5,062,727, S. Kageyama et al., issued Nov. 5, 1991 and assigned to the assignee of the present application, U.S. Pat. No. 5,207,522, S. Kageyama et al., issued May 4, 1993 and assigned to the assignee of the present application, U.S. Pat. No. 5,236,270, S. Kageyasma et al., issued Aug. 17, 1993 and assigned to the assignee of the present application, and U.S. Pat. No. 5,370,471, S. Kageyama et al., issued Dec. 6, 1994 and assigned to the assignee of the present application, each discloses a mechanical pencil of rear-knock-type provided with a dispenser for selectively extending and retracting a stick-shaped object. The conventional mechanical pencil generally includes a barrel, a head member threadedly attached to a front end of the barrel, and a writing lead feeding mechanism in addition to the dispenser.

The lead feeding mechanism includes a sleeve, a chuck for releasably gripping a writing lead, the chuck having a forward enlarged head and a tubular section extending from the chuck bead, and inserted in the sleeve with the chuck head projecting out of the sleeve, a chuck ring disposed around the chuck head, a writing lead tank having first and second ends, the writing lead tank connected at the first end thereof to the tubular section of the chuck, and a spring disposed within the sleeve to resiliently urge the writing lead tank rearwardly of the mechanical pencil.

The dispenser includes an outer tubular cap, an inner tubular body having first and second end portions, and a holder movably inserted in the first end section of the inner tubular body for holding a stick-shaped object. The holder has a pair of holding pieces and a projection provided on each of the holding pieces. The first end section of the tubular body is formed with a pair of axially extending slits in which respective ones of the holding pieces of the holder are slidably received. The outer tubular cap has a spiral groove formed in an inner surface section thereof. The first end portion of the inner tubular body, which has the holder incorporated therein, is fitted in the outer tubular cap with the projections of the holder being engaged with the spiral groove of the outer tubular cap. The second end portion of the inner tubular body is projected out of the outer tubular cap. An axial movement of the inner tubular body relative to the outer tubular cap is prevented but rotational movement of the inner tubular body relative to the outer tubular cap is allowed.

The dispenser is detachably attached to a rear end portion of the pencil barrel, having the writing lead feeding mechanism incorporated therein, with the second end section of the inner tubular body thereof being fitted on the second end portion of the writing lead tank in the pencil barrel and with the second end section of the tubular body thereof being fitted in the rear end portion of the pencil barrel. In the conventional mechanical pencil, axial movement of the dispenser relative to the pencil barrel is allowed but rotational movement of the inner tubular body of the dispenser relative to the pencil barrel is prevented.

In the mechanical pencil constructed as stated above, turning of the outer tubular cap causes the holder with the projections engaged with the spiral groove to be moved in an axial direction along the spiral groove, whereby the stick-shaped object held by the bolder can be extended from or retracted into the rear end of the outer tubular cap in response to the turning of the outer tubular cap.

In the conventional mechanical pencil, the second end portion of the inner tubular body is connected to the second end of the writing lead tank. Advancing of a writing lead can be performed by knocking a rear end of the dispenser to thrust the writing lead tank forward against the action of the spring. The conventional mechanical pencil is of the rear-knock-type. There has not been yet proposed a writing instrument of side-knock-type or side-slide-type with a dispenser for selectively extending and retracting a substantially stick-shaped object.

With the conventional mechanical pencil constructed as stated above, the second end section of the inner tubular body of the dispenser is projected out of the outer tubular cap and the outer tubular cap of the dispenser is loosely mounted on the pencil barrel in order to ensure a smooth knocking operation of the dispenser relative to the pencil barrel and coupling between the pencil barrel and the dispenser is achieved only by causing the second end section of the inner tubular body of the dispenser to be fitted on the second end of the writing lead tank, so that there is a possibility that the second end section of the inner tubular body in the pencil barrel will be bent or broken when any external force is accidentlly applied to a region between the pencil barrel and outer tubular cap.

SUMMARY OF THE INVENTION

Accordingly, it is an object of the present invention to provide a dispenser for selectively extending and retracting a stick-shaped object, which has an additional chamber for storing at least one spare stick-shaped object therein.

It is another object of the present invention to provide a dispenser for selectively extending and retracting a substantially stick-shaped object, in which a dispenser structure of the dispenser is received in pocket means, whereby the dispenser structure is protected from any external force.

It is still another object of the present invention to provide a writing instrument of side-knock-type or side-slide-type with a dispenser for selectively extending and retracting a substantially stick-shaped object.

BRIEF DESCRIPTION OF THE DRAWINGS

These and other objects and many of the attendant advantages of the present invention will be readily appreciated as the same become better understood by reference to the following detailed description when considered in connection with the accompanying drawings, in which like reference numerals designate the same parts throughout the Figures and wherein.

DETAILED DESCRIPTION OF THE PREFERRED EMBODIMENTS

Figure 1:
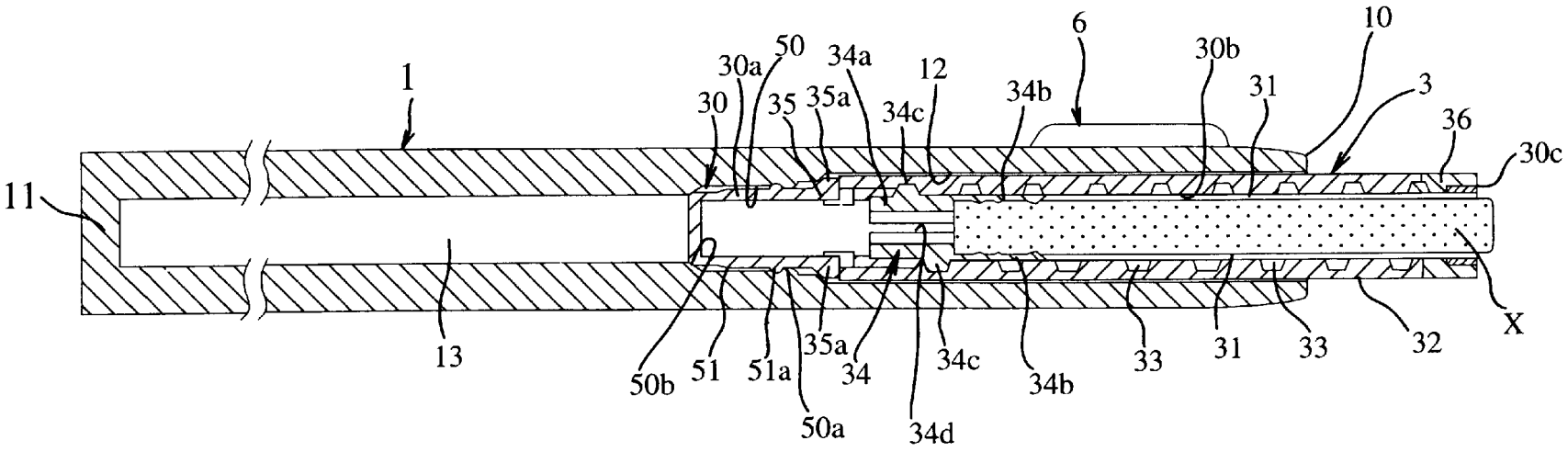
FIG. 1 is a schematic longitudinal sectional view of a dispenser for selectively extending and retracting a substantially stick-shaped object according to a first embodiment of the present invention.
Figure 4:
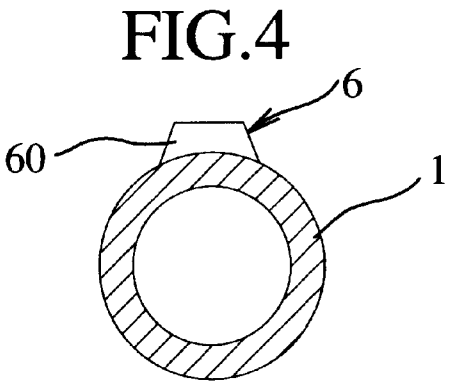
FIG. 4 is a schematic sectional view of the outer tubular casing.
Figure 2:
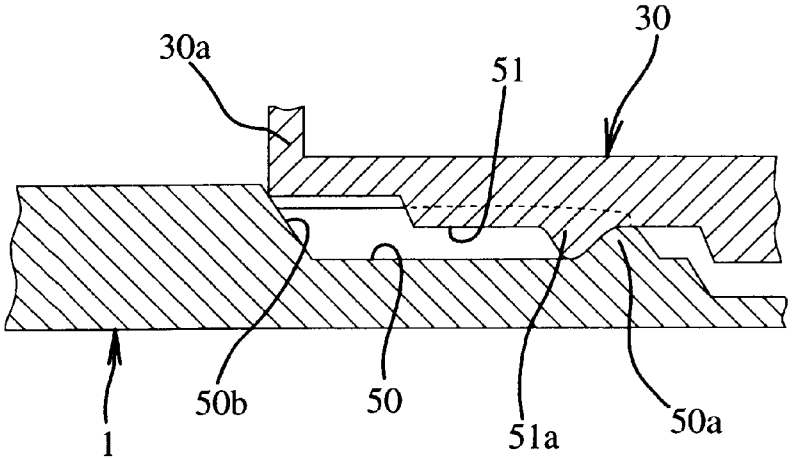
FIG. 2 is a schematic enlarged segmentary sectional view of assistance in explaining a relationship between an outer tubular casing and a guide sleeve of a dispenser structure.
Figure 3:
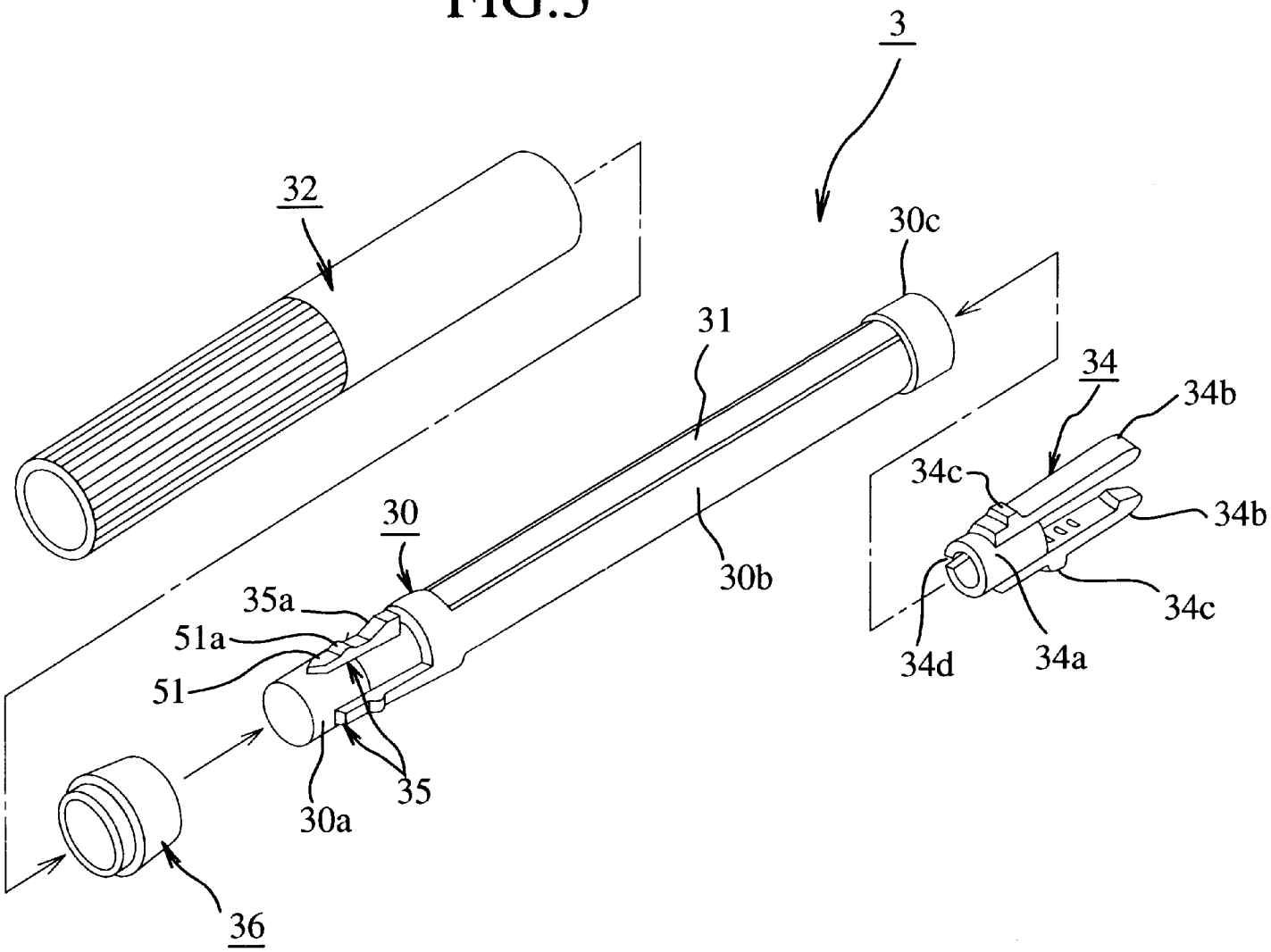
FIG. 3 is a schematic exploded perspective view of the dispenser structure.

Now, the present invention will be discussed hereinafter with reference to the accompanying drawings.

Referring to FIGS. 1 to 4, there is illustrated a dispenser for selectively extending and retracting a substantially stick-shaped object X according to a first embodiment of the present invention. The dispenser comprises an outer tubular casing 1, a dispenser structure 3 removably received in the outer tubular casing 1 with a rear section thereof projecting out of the outer tubular casing 1, first cooperating means on the outer tubular casing 1 and guide sleeve 30 of the dispenser structure 3 for preventing rotational movement of the guide sleeve 30 of the dispenser structure 3 relative to the outer tubular casing 1, and second cooperating means on the outer tubular casing 1 and dispenser structure 3 for retaining the dispenser structure 3 in a first chamber 12 of the outer tubular casing 1.

The outer tubular casing 1 has an opened end 10, a closed end 11, a first chamber 12 adjacent the opened end 10 for receiving the dispenser structure 3, and a second chamber 13 adjacent the closed end 11 for storing at least one stick-shaped object therein (not shown).

The dispenser structure 3 comprises a guide sleeve 30 having a pair of axially extending slits 31, a tubular member 32 rotatably mounted on the guide sleeve 30 and having a spiral groove 33 formed in an inner peripheral portion thereof, holder means 34 movably received in the guide sleeve 30 for holding the substantially stick-shaped object X, and means for preventing axial movement of the tubular member 32 relative to the guide sleeve 30. The holder means 34 includes a tubular base section 34*a*, a pair of holding pieces 34*b* extending from the tubular base section 34*a* for holding the stick-shaped object X therebetween, and at least one projection 34*c* provided on the holding pieces 34*b*. In the illustrated embodiment, a pair of projections 34*c* are provided on the holding pieces 34*b*. Each of the holding pieces 34*b* is slidably received in corresponding one of the axially extending slits 31 of the guide sleeve 30. Each of the projections 34*c* projects out of the guide sleeve 30 through corresponding one of the axially extending slits 31 and is engaged with the spiral groove 33 of the tubular member 32 mounted on the guide sleeve 30. Incidentally, the tubular base section 34*a* is formed with an axially extending slit 34*d*, so that a peripheral wall of the tubular base section 34*a* can be deformed in a manner to allow a diameter of the tubular base section 34*a* to be reduced. Therefore, incorporating of the holder means 34 in the guide sleeve 30 can be easily performed while causing the peripheral wall of the tubular base section 34*a* to be deformed in a manner to allow the diameter of the tubular base section 34*a* to be reduced.

The guide sleeve 30 has a first section 30*a* projecting out of the tubular member 32, and a second section 30*b* in which the holder means 34 is incorporated The &cans for preventing axial movement of the tubular member 32 relative to the guide sleeve 30 comprises resilient pieces 35 formed in the first section 30*a* of the guide sleeve 30 by cutting a peripheral wall of the guide sleeve 30, a ring-like portion 30*c* provided around an end of the second section 30*b*, and a ring member 36 mounted on the ring-like portion 30*b* of the guide sleeve 30. Provided on a free end of each of the resilient pieces 35 is a radially projecting portion 35*a*. One end of the tubular member 32 is engaged with the radially projecting portions 35*a* of the resilient pieces 35 of the guide sleeve 30, thereby preventing movement of the tubular member 32 in a left direction of FIG. 1 relative to the guide sleeve 30. Further, the other end of the tubular member 32 is engaged with the ring member 36, whereby movement of the tubular member 32 in a right direction of FIG. 1 relative to the guide sleeve 30. Thus, axial movement of the tubular member 32 relative to the guide sleeve 30 is prevented.

The first cooperating means on the outer tubular casing 1 and guide sleeve 30 of the dispenser structure 3 for preventing rotational movement of the guide sleeve 30 of the dispenser structure 3 relative to the outer tubular casing 1 comprises spaced apart key grooves 50 disposed around a first region of an inner periphery of the first chamber 12 of the outer tubular casing 1, and spaced apart keys 51 disposed around an outer periphery of the first section 30*a* of the guide sleeve 30. The number of the keys 51 corresponds to that of the key grooves 50. The second cooperating means on the outer tubular casing 1 and guide sleeve 30 of the dispenser structure 3 for retaining the dispenser structure 3 in the first chamber 12 of the outer tubular casing 1 comprises a first projection 50*a* provided at each of the key grooves 50 of the outer tubular casing 1, a circumferential step portion 50*b* disposed around a second region of the inner periphery of the outer tubular casing 1, and a second projection 51*a* provided on each of the keys 51 of the dispenser structure 3 Then the dispenser structure 3 is inserted into the first chamber 12 of the outer tubular casing 1, each of the keys 51 of the guide sleeve 30 is received in corresponding one of the key grooves 50, whereby rotational movement of the guide sleeve 30 relative to the outer tubular casing 1 is prevented Also, during the insertion of the dispenser structure 3 into the outer tubular casing 1, the second projection 51*a* provided on each of the keys 51 of the guide sleeve 30 of the dispenser structure 3 goes over corresponding one of the first projections 50*a* of the outer tubular casing 1 At this time, the first section 30*a* of the guide sleeve 30 of the dispenser structure 3 is abutted against the circumferential step portion 50*b* of the outer tubular casing 1, whereby the second projection 51*a* provided on each of the keys 51 of the guide sleeve 30 of the dispenser structure 3 is engaged with the corresponding one of the first projections 50*a* of the outer tubular casing 1, and the first section 30*a* of the guide sleeve 30 of the dispenser structure 3 is engaged with the circumferential step portion 50*b* of the outer tubular casing 1. Thus, the dispenser structure 3 is securely retained in the first chamber 12 of the outer tubular casing 1 by the second cooperating means, and the rotational movement of the guide sleeve 30 of the dispenser structure 3 relative to the outer tubular casing 1 is prevented by the first cooperating means.

A clip (not shown) say be provided at the outer tubular casing 1 for clipping the dispenser to a shirt or jacket pocket or the like. Further, means 6 for preventing rolling of the dispenser nay be employed. In the illustrated embodiment, the means 6 comprises a body 60 of a substantially trapezoidal-shape in cross section provided on the outer tubular casing 1. Alternatively, the outer tubular casing 1 nay be formed into a substantially polygonal shape in cross section in order to prevent rolling of the dispenser.

The operation of the dispenser according to the first embodiment of the present invention will be discussed hereinafter. When the tubular member 32 of the dispenser structure 3 received in the first chamber 12 of the outer tubular casing 1 is turned relative to the guide sleeve 30 of the dispenser structure 3 which is prevented from being rotationally moved relative to the outer tubular casing 1 by the first cooperating means, or when the outer tubular casing 1 is turned relative to the tubular member 32, the the holder means 34 incorporated in the guide sleeve 30 is moved axially while being guided along the axially extending slits 31 of the guide sleeve 30 and moving along the spiral groove 33 of the tubular member 32 of the dispenser structure 3. As the holder means 34 is moved axially by turning of the tubular member 32 of the dispenser structure 3 relative to the guide sleeve 30 or turning of the outer tubular casing 1 relative to the tubular member 32, the stick-shaped object X held by the holder means 34 can be extended outwardly from or retracted into the tubular member 32 of the dispenser in response to the turning movement of the tubular member 32 of the dispenser structure 3 relative to the guide sleeve 30 of the dispenser structure 3 or the turning movement of the outer tubular casing 1 relative to the tubular member 32. The object X can be used in an extended state When the stick-shaped object X is consumed, resulting in the stick-shaped object X becoming shortened and it is necessary to replace the shortened object X with the unshown spare stick-shaped object, the dispenser structure 3 is removed from the outer tubular casing 1 by drawing of the dispenser structure 3 out of the outer tubular casing 1. In this condition, the unshown spare stick-shaped object can be taken out of the outer tubular casing 1 through the opened end 10 of the outer tubular casing 1, and the shortened stick-shaped object X can be replaced with the spare stick-shaped object. When the shortened stick-shaped object X is to be replaced with the spare stick-shaped object, the guide sleeve 30 of the removed dispenser structure 3 is repeatedly turned relative to the tubular member 32 in such a direction as to cause the shortened object X to be extended outwardly from the dispenser structure 3, or the tubular member 32 is repeatedly turned relative to the guide sleeve 30 in the same direction, thereby causing the shortened stick-shaped object X to be extended outwardly from the dispenser structure 3. In this condition, the shortened stick-shaped object X is removed from the holding pieces 34*b* of the hoder means 34. Then, the spare stick-shaped object is held between the holding pieces 34*b* of the holder means 34. By turning of the tubular member 32 relative to the guide sleeve 30 in such a direction as to cause the spare stick-shaped object to be retracted into the dispenser structure 3, or by turning of the guide sleeve 30 relative to the tubular member 32 in the same direction, the spare stick-shaped object is retracted into the guide sleeve 30. In state where the spare object is completely retracted into the guide sleeve 30, the dispenser structure 3 is inserted into the first chamber 12 of the outer tubular casing 1.

Figure 5:
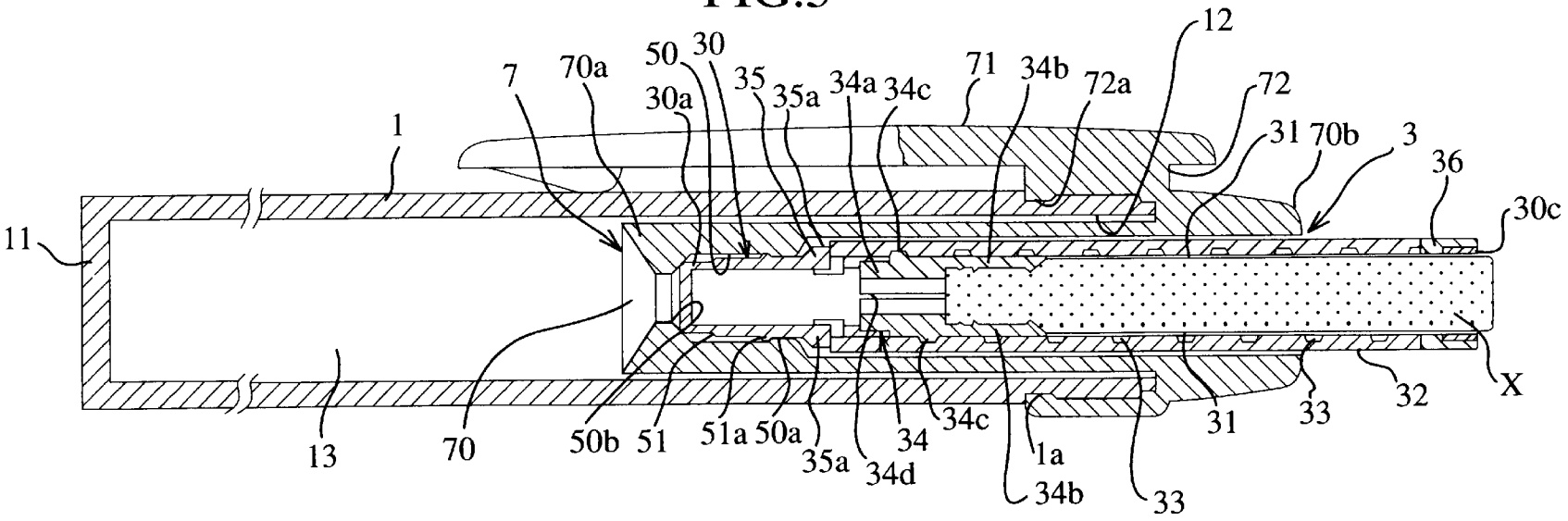
FIG. 5 is a schematic longitudinal sectional view of a dispenser for selectively extending and retracting a substantially stick-shaped object according to a second embodiment of the present invention.

Referring to FIG. 5, there is illustrated a dispenser according to a second embodiment of the present invention. The dispenser is substantially similar to that according to the first embodiment of the present invention except that the first chamber 12 of the outer tubular casing 1 comprises pocket means 7 for receiving the dispenser structure 3, the spaced apart key grooves 50 of the first cooperating means are provided at the pocket means 7, and the circumferential step portion 50*b* of the second cooperating means is provided at the pocket means 7. In the second embodiment of FIG. 5, components which are substantially similar to those shown in FIGS. 1 to 4 are designated with like reference numerals and the description of them will not be repeated. In the second embodiment, a stick-shaped rubber eraser is employed as the stick-shaped object X and a plurality of writing leads (not shown) are adapted to be stored in the second chamber 13 of the outer tubular casing 1.

The pocket means 7 is removably mounted in the first chamber 12 of the outer tubular casing 1. The pocket means 7 comprises a tubular body 70, a clip portion 71 for clipping the dispenser to a shirt or jacket pocket or the like, and an intermediate section 72 of a substantially ring-shape interconnecting the tubular body 70 and the clip portion 71. The tubular body 70 has a first end portion 70*a* and a second end portion 70*b*. The first end portion 70*a* has an inner periphery of a substantially funnel-shape having a diameter which is gradually increased toward an exterior of the tubular body 70. The intermediate section 72 encloses a region adjacent the second end portion 70*b* of the tubular body 70 with a circular clearance being left between the tubular body 70 and the intermediate section 72. In the illustrated embodiment, the pocket means 7 takes the form of one piece having the tubular body 70, the clip portion 71 and the intermediate section 72. The ring-shaped intermediate section 72 has a circumferential projection 72*a* around an inner periphery thereof. Bearing on this, the outer tubular casing 1 has a circumferential groove 1*a* formed in an outer peripheral region thereof which positionally corresponds to the circumferential projection 72*a* of the intermediate section 72 of the pocket means 7 when the pocket means 7 is mounted in the outer tubular casing 1. The pocket means 7 is attached to the outer tubular casing 1 with the tubular body 70 thereof being received in the first chamber 12 of the outer tubular casing 1, with the ring-like intermediate section 72 thereof being fitted on the outer tubular casing 1, and with the circumferential projection 72*a* of the intermediate section 72 being engaged with the circumferential groove 1*a* of the outer tubular casing 1. The spaced apart key grooves 50 of the first cooperating means are disposed around an inner periphery of the tubular body 70. In the illustrated emdbodiment of FIG. 5, as described above, the first end portion 70*a* of the tubular body 70 of the pocket means 7 has the inner periphery of the substantially funnel-shape having the diameter which is gradually increased toward the exterior of the tubular body 70. Therefore, when unshown writing leads stored in the second chamber 13 are to be taken out of the outer tubular casing 1 through the second end portion 70*b*, the writing leads can be securely moved from the second chamber 13 of the outer tubular casing 1 to the first chamber 12 while being guided by the funnel-shaped inner periphery of the tubular body 70 of the pocket means 7.

Figure 6:
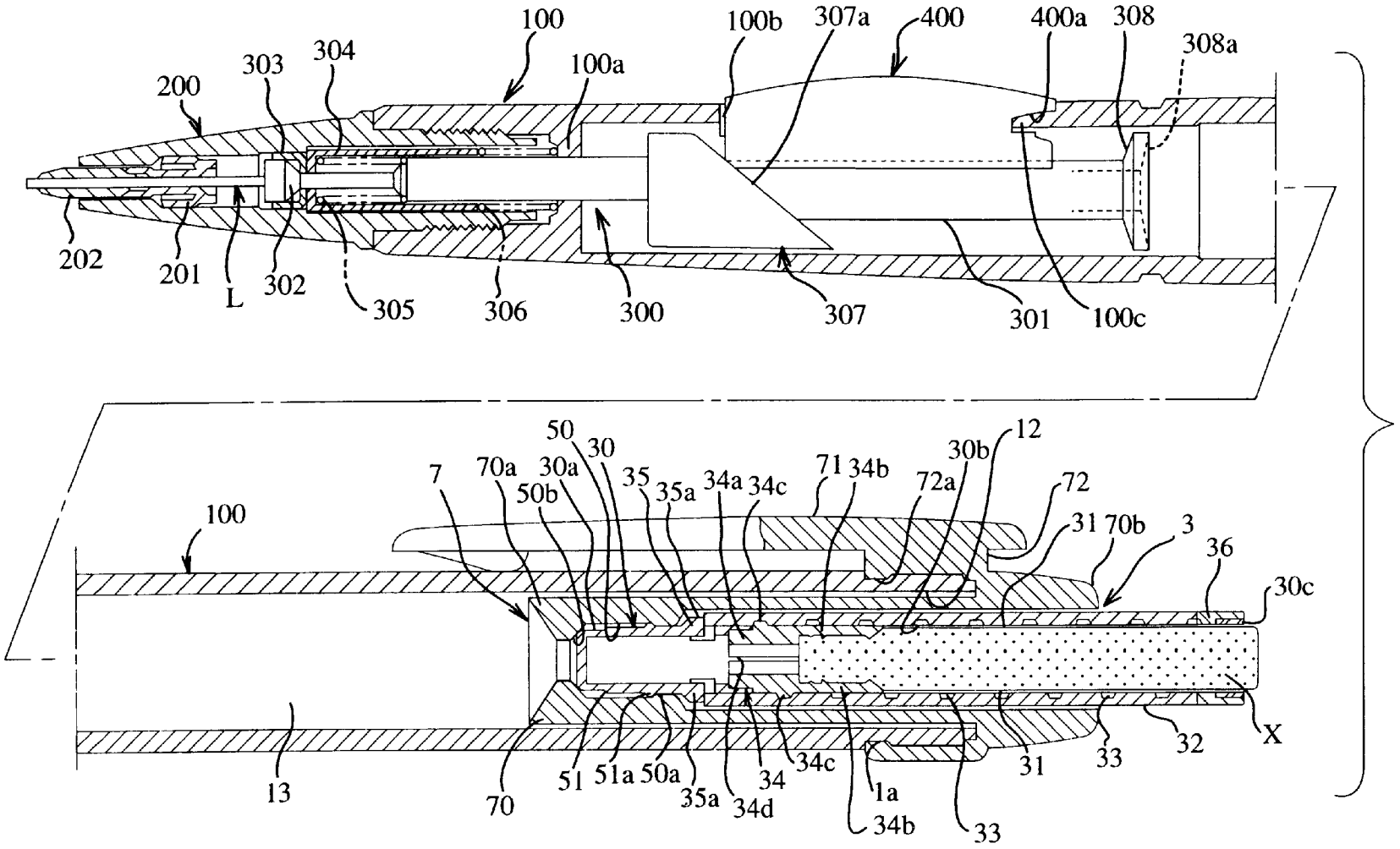
FIG. 6 is a schematic longitudinal sectional view of a mechanical pencil of side-knock-type with a dispenser for selectively extending and retracting a substantially stick-shaped object.

Referring to FIG. 6, there is illustrated a mechanical pencil of side-knock-type with a modification of the dispenser of FIG. 5, The modification is substantially similar to the embodiment of FIG. 5 except that a rear portion of the pencil barrel 100 is used as the outer tubular casing 1. The mechanical pencil may have no additional chamber for storing a plurality of writing leads therein or may have such an additional chamber 13. In the modification, components which are substantially similar to those of FIG. 5 are designated with like reference numerals and the description of them will not be repeated.

The mechanical pencil generally includes a head member 200 threadedly attached to a front end of the pencil barrel 100, means 300 for advancing a writing lead L, and actuator means 400 for actuating the writing lead advancing means 300. The head member 200 has a slider 201 incorporated therein, and a writing lead pipe 202 connected to the slider 201.

The writing lead advancing means 300 is incorporated in the pencil barrel 100. The writing lead advancing means 300 includes a writing lead passageway 301, a chuck 302 connected to a front end of the writing lead passageway 301, a chuck ring 303 disposed around the chuck 302, a sleeve 304 mounted on the writing lead passageway 301 and abutted against a rear end of the chuck ring 303, a first spring 305 disposed between the sleeve 304 and the front end of the writing lead passageway 301, and a second cushion spring 306 disposed between the sleeve 304 and a circumferential step portion 100*a* formed around an inner periphery of the pencil barrel 100 The writing lead advancing means 300 is always urged rearwardly by means of the spring 305. The writing lead passageway 301 has a first enlarged outer diameter portion 307 provided at an approximately middle portion of its longitudinal direction, and a second enlarged outer diameter portion 308 formed at a rear end of the lead passageway 301. The first enlarged outer diameter portion 307 has a slant surface 307*a* which slopes in a rearward direction. The second enlarged outer diameter portion 308 has an outer diameter which is slightly smaller than an inner diameter of the pencil barrel 100. Further, the second enlarged outer diameter portion 308 has a tapered inner periphery 308*a* having a diameter that is gradually increased in a rearward direction. The presence of the tapered inner periphery 308*a* facilitates introduction of a writing lead into the lead passageway 301.

The pencil barrel 100 has an opening portion 100*b* formed in a region thereof which positionally corresponds to the first enlarged outer diameter portion 307 of the lead passageway 301. The actuator means 400 is pivotally supported at the opening portion 100*b* of the pencil barrel 100. More particularly, the actuator means 400 comprises a substantially inverted U-shaped body in cross section. The inverted U-shaped body of the actuator means 400 has notches 400*a* (only one shown in FIG. 6) formed in both sides of the inverted U-shaped body. The actuator means 400 is fitted in the opening portion 100*b* of the pencil barrel 100 with the notches 400*a* thereof receiving a supporting projection 100*c* of the opening portion 100*b* of the pencil barrel 100 and with a part of the actuator means 400 being abutted against the slant surface 307*a* of the first enlarged outer diameter portion 307 of the lead passageway 301, so that the actuator means 400 can be pivoted radially relative to the pencil barrel 100 when the actuator means 400 is pushed inwardly of the pencil barrel 100 by a user Then the actuator means 400 is pushed inwardly of the pencil barrel 100 by the user, of the writing lead passageway 301 and chuck 302 is forwarded, whereby the writing lead L is advanced and passes through the pipe 202. Incidentally, by removing the dispenser structure 3 from the pocket means 7, spare writing leads can be put into the pencil barrel 100 from a rear end of the mechanical pencil.

Figure 7:
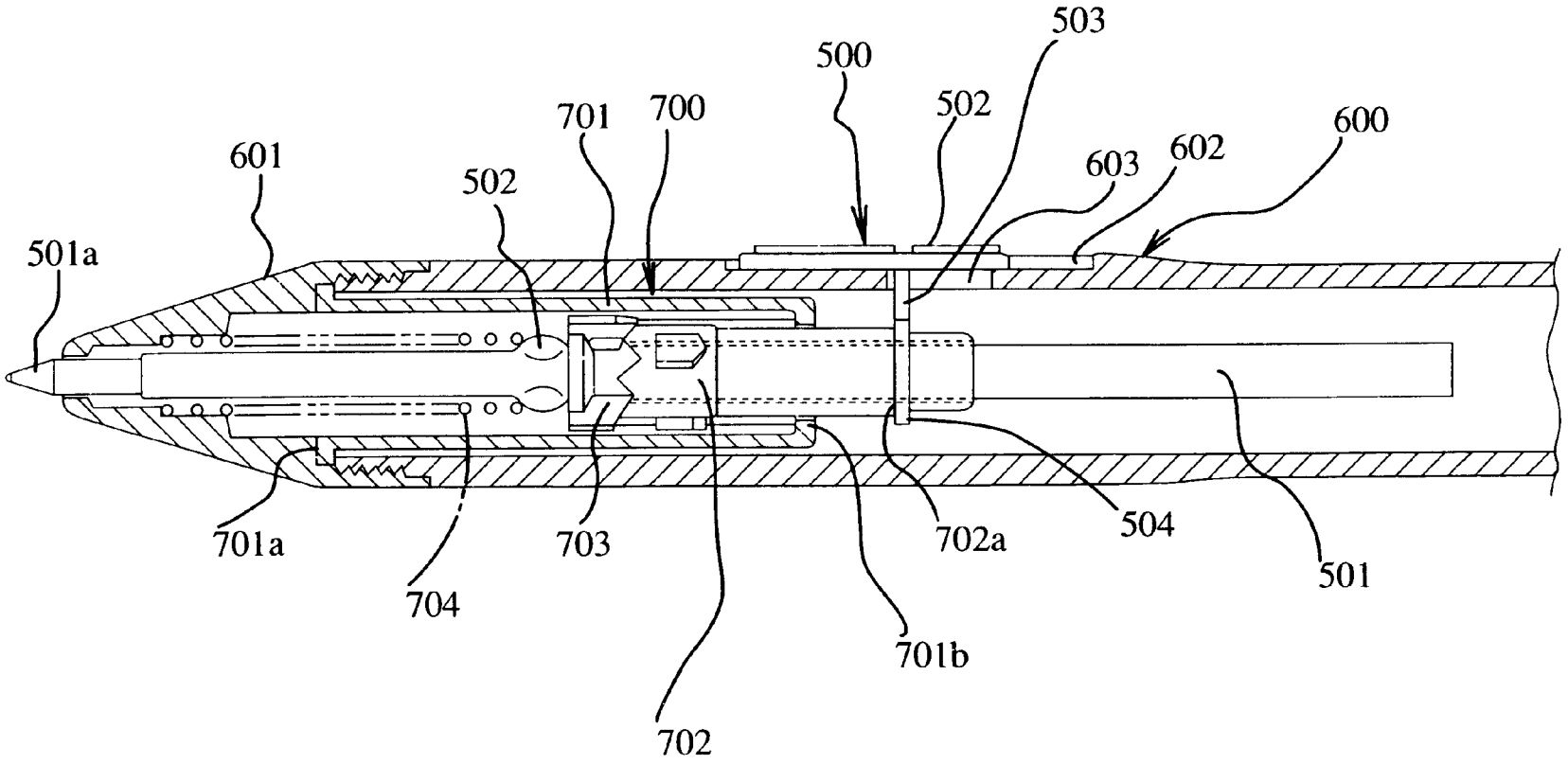
FIG. 7 is a schematic longitudinal sectional view of a ball-point pen of side-slide-type with a dispenser for selectively extending and retracting a substantially stick-shaped object.

Referring to FIG. 7, there is illustrated a ball-point pen of side-slide-type with the dispenser of FIG. 6. In FIG. 7, the dispenser is not shown. In the ball-point pen of FIG. 7, actuator means 500 for advancing a refill 501, which is different from the actuator means 400 of FIG. 6 is employed. A rear portion of a pen barrel is used as the outer tubular body of the unshown dispenser.

The ball-point pen generally includes a pen barrel 600, a head member 601 threadedly attached to a front end of the pen barrel 600r can means 700 incorporated in the pen barrel 600, and actuator means 500 for actuating the can means 700 to advance the refill 501.

The cam means 700 includes a cam body 701 incorporated in the pen barrel 600, a first cam member 702 received in the cam body 701, and a second rotary cam member 703 disposed in the can body 701 and engaged with the first cam member 702.

The cam body 701 takes the form of a substantially sleeve, and has a circumferential flange 701*a* around a front end portion thereof and a circumferential projection 701*b* which is formed at a rear end portion of the cam body 701 and projects inwardly. The circumferential flange 701*a* of the can body 701 is interposed between the pen barrel 600 and the head member 601. The presence of the circumferential projection 701*b* of the cam body 701 prevents the first cam member 702 from dropping out of the cat body 701. The refill 501 penetrates the first cam member 702 and second cam member 703. Disposed between the bead member 601 and a receiving section 502 of the refill 501 is a spring 704 which always urges the refill 501, including the first and second cam members 702, 703 mounted on the refill 501, in a backward direction.

The actuator means 500 includes an operating element 502 of a substantially plate-shape which is slidably received in a recess portion 602 formed in a region of the pen barrel 600, a rod 503 hanging from the operating element 502 inwardly of the pen barrel 600 and penetrating an elongated slit 603 of the pen barrel 600, and a ring-shaped portion 504 provided at a tip end of the rod 503. The first cam member 702 has a circumferential step portion 702*a* with which the ring-shaped portion 504 of the actuator means 500 is engaged.

The operation of the ball-point pen will be discussed hereinafter. When the operating element 502 is slid forwardly against the action of the spring 704 by the user, the first cam member 702 is thrust forwardly, thereby causing the second cam member 703 to be rotated through a predetermined angle. At this time, the second cam member 703 becomes engaged with the can body 701, thereby advancing the refill 501. As a result, a writing tip 501*a* of the refill 501 is operatively projected out of the head member 601. In a state shown in FIG. 7, when the operating element 502 is again slid forwardly, the ring-shaped portion 504 of the actuator means 500 causes the first can member 702 to be thrust forwardly, resulting in the can body 701 and the second can member 703 being disengaged from each other. An a result, the refill 501 is retracted into the pen barrel 600 due to the action of the spring 704.

The term and expressions which have been employed arc used as terms of description and not of limitation, and there is no intention in the use of such terms and expression of excluding any equivalents of the features shown and described, or portion thereof, but it is recognized that various modifications are possible within the scope of the invention claimed.

What is claimed is:

1. A mechanical pencil of side-knock-type comprising, a barrel having an opening portion formed in a region of a peripheral wall thereof;

means incorporated within said barrel for advancing a writing lead;

spring means incorporated within said barrel to urge said writing lead advancing means rearwardly;

actuator means received in said opening portion of said barrel and engaged with a portion of said writing lead advancing means for actuating said writing lead advancing means against an action of said spring means;

stationary pocket means mounted within a rear end portion of said barrel, said pocket means including a tubular body substantially within said barrel and an extension extending from said tubular body, said pocket means further including an intermediate portion connecting to said extension outside said barrel;

clip means extending outwardly of said barrel from said pocket means for clipping said mechanical pencil to a shirt or jacket pocket or the like;

said intermediate portion connecting to said clip means such that said pocket means and clip means are formed as a one-piece member; and a dispenser removably mounted in said pocket means for selectively extending and retracting a substantially stick-shaped object independently of said pocket means including said tubular body, extension and intermediate portion.

2. A mechanical pencil of claim 1, wherein said dispenser comprises:

a guide sleeve having a pair of axially extending slits;

a tubular member rotatably mounted on said guide sleeve, said tubular member having a spiral groove formed in an inner peripheral portion thereof;

means on said guide sleeve for preventing axial movement of said tubular member relative to said guide sleeve; and holder means movably received within said guide sleeve for holding said stick-shaped object, said holder means having a pair of holding pieces and a projection provided on each of said holding pieces, said projection projecting out of said guide sleeve through corresponding one of said axially extending slits of said guide sleeve and engaged with said spiral groove of said tubular member.

3. A mechanical pencil of claim 2, further comprising first cooperating means on said pocket means and said dispenser for preventing rotational movement of said guide sleeve of said dispenser relative to said pocket means.

4. A mechanical pencil of claim 3, wherein said writing lead advancing means includes:

a writing lead passageway;

a chuck connected to a front end of said writing lead passageway; and a chuck ring disposed around said chuck, said writing lead passageway having a first enlarged outer diameter portion and a second enlarged outer diameter portion formed at a rear end portion of said writing lead passageway, said first enlarged outer diameter portion having a slant surfaces sloping in rearward direction, said actuator means being engaged with said slant surface, said second enlarged outer diameter having a tapered inner periphery having a diameter that is gradually increased in the rearward direction.

5. A mechanical pencil of claim 2, further comprising second cooperating means on said pocket means and said dispenser for retaining said dispenser in said pocket means.

6. A mechanical pencil of claim 5, wherein said writing lead advancing means includes;

a writing lead passageway;

a chuck connected to a front end of said writing lead passageway; and a chuck ring disposed around said chuck, said writing lead passageway having a first enlarged outer diameter portion and a second enlarged outer diameter portion formed at a rear end portion of said writing lead passageway, said first enlarged outer diameter portion having a slant surface sloping in a rearward direction, said actuator means being engaged with said slant surface, said second enlarged outer diameter having a tapered inner periphery having a diameter that is gradually increased in the rearward direction.

7. A mechanical pencil of claim 2, wherein said writing lead advancing means includes:

a writing lead passageway;

a chuck connected to a front end of said writing lead passageway; and a chuck ring disposed around said chuck, said writing lead passageway having a first enlarged outer diameter portion and a second enlarged outer diameter portion formed at a rear end portion of said writing lead passageway, said first enlarged outer diameter portion having slant surface sloping in a rearward direction, said actuator means being engaged with said slant surface, said second enlarged outer diameter having a tapered inner periphery having a diameter that is gradually increased in the rearward direction.

8. A mechanical pencil of claim 1, further comprising first cooperating means on said pocket means and said dispenser for preventing rotational movement of a portion of said dispenser relative to said pocket means.

9. A mechanical pencil of claim 8, further comprising cooperating means on said pocket means and said dispenser for retaining said dispenser in said pocket means.

10. A mechanical pencil of claim 9, wherein said writing lead advancing means includes:

a writing lead passageway;

a chuck connected to a front end of said writing lead passageway; and a chuck ring disposed around said chuck, said writing lead passageway having a first enlarged outer diameter portion and a second enlarged outer diameter portion formed at a rear end portion of said writing lead passageway, said first enlarged outer diameter portion having a slant surface sloping in a rearward direction, said actuator means being engaged with said slant surface, said second enlarged outer diameter having a tapered inner periphery having a diameter that is gradually increased in the rearward direction.

11. A mechanical pencil of claim 8, wherein said writing lead advancing means includes:

a writing lead passageway;

a chuck connected to a front end of said writing lead passageway, and a chuck ring disposed around said chuck, said writing lead passageway having a first enlarged outer diameter portion and a second enlarged outer diameter portion formed at a rear end portion of said writing lead passageway, said first enlarged outer diameter portion having slant surface sloping in a rearward direction, said actuator means being engaged with said slant surface, said second enlarged outer diameter having a tapered inner periphery having a diameter that is gradually increased in the rearward direction.

12. A mechanical pencil of claim 1, further comprising cooperating means on said pocket means and said dispenser for retaining said dispenser in said pocket means.

13. A mechanical pencil of claim 12, wherein said writing lead advancing means includes:

a writing lead passageway;

a chuck connected to a front end of said writing lead passageway; and a chuck ring disposed around said chuck, said writing lead passageway having a first enlarged outer diameter portion and a second enlarged outer diameter portion formed at a rear end portion of said writing lead passageway, said first enlarged outer diameter portion having a slant surface sloping in a rearward direction, said actuator means being engaged with said slant surface, said second enlarged outer diameter having a tapered inner periphery having a diameter that is gradually increased in the rearward direction.

14. A mechanical pencil of claim 1, wherein said writing lead advancing means includes:

a writing lead passageway;

a chuck connected to a front end of said writing lead passageway; and a chuck ring disposed around said chuck, said writing lead passageway having a first enlarged outer diameter portion and a second enlarged outer diameter portion formed at a rear end portion of said writing lead passageway, said first enlarged outer diameter portion having a slant surface sloping in a rearward direction, said actuator means being engaged with said slant surface, said second enlarged outer diameter having a tapered inner periphery having a diameter that is gradually increased in the rearward direction.

* * * * *